US012134902B2

(12) United States Patent
Taggart et al.

(10) Patent No.: US 12,134,902 B2
(45) Date of Patent: Nov. 5, 2024

(54) CROWN MOLDING SUPPORT HANGER

(71) Applicants: Richard Taggart, Grass Valley, CA (US); Nancy Taggart, Grass Valley, CA (US)

(72) Inventors: Richard Taggart, Grass Valley, CA (US); Nancy Taggart, Grass Valley, CA (US)

( * ) Notice: Subject to any disclaimer, the term of this patent is extended or adjusted under 35 U.S.C. 154(b) by 0 days.

(21) Appl. No.: 17/380,515

(22) Filed: Jul. 20, 2021

(65) Prior Publication Data

US 2023/0392391 A1 Dec. 7, 2023

(51) Int. Cl.
*E04F 21/18* (2006.01)

(52) U.S. Cl.
CPC ..... *E04F 21/185* (2013.01); *E04F 21/1855* (2013.01)

(58) Field of Classification Search
CPC ... E04F 19/04; E04F 19/0436; E04F 19/0481; E04F 21/0069; E04F 21/185; E04F 21/1855; B25B 11/02
See application file for complete search history.

(56) References Cited

U.S. PATENT DOCUMENTS 3,616,587 A * 11/1971 Schlafly, Jr. ..... E04F 19/0436 52/287.1
5,768,830 A * 6/1998 Kelly ..... F16M 11/24 52/127.2
6,911,597 B2 * 6/2005 Seamans ..... H02G 3/266 174/95
7,578,492 B2 * 8/2009 Darre' ..... A47G 1/202 248/217.4
7,958,685 B2 * 6/2011 Rowohlt ..... E04F 19/0436 52/287.1
8,157,228 B2 * 4/2012 Smith ..... E04F 21/1855 248/323
9,683,377 B1 * 6/2017 Eisinger ..... E04F 19/0463
2002/0174618 A1 * 11/2002 Carroll ..... E04F 21/1855 52/549
2007/0256385 A1 * 11/2007 Walda ..... E04F 21/1855 52/545

(Continued)

FOREIGN PATENT DOCUMENTS

EP 1882793 A2 * 1/2008 ..... E04F 21/185
GB 2552210 A * 1/2018 ..... E04F 21/18

(Continued)

*Primary Examiner* — Ryan D Kwiecinski

(57) ABSTRACT

A crown molding support hanger described herein as comprised of a lightweight durable plastic crown molding support hanger that is an essential crown molding installation tool for all sizes of crown molding that may be quickly and effectively installed by a single user. The crown molding support hanger has a support surface that engages and holds a length of crown molding while the mounting member secures the crown molding support hanger to the wall. The support member is adjustable to the different sizes and shapes of decorative trim molding by simply snapping off the tab on the support surface that engages the front section of the molding. The mounting member is removable from the support member by moving the support member side to side and snapping the support member tab at the v-groove, releasing the support member. The mounting member remains hidden behind the crown molding.

4 Claims, 10 Drawing Sheets

(56) References Cited

U.S. PATENT DOCUMENTS

| | | | | |
|---|---|---|---|---|
| 2008/0016807 | A1* | 1/2008 | Barter | E04F 21/185 52/288.1 |
| 2008/0135701 | A1* | 6/2008 | Smith | E04F 21/1855 248/295.11 |
| 2008/0250905 | A1* | 10/2008 | Khan | E04F 21/0069 269/45 |
| 2010/0018070 | A1* | 1/2010 | Duquette | E04F 21/1855 33/647 |
| 2013/0031867 | A1* | 2/2013 | Duquette | E04F 21/1855 52/749.11 |
| 2013/0047550 | A1* | 2/2013 | Duquette | E04F 21/1855 52/749.1 |
| 2013/0056592 | A1* | 3/2013 | Greenhalgh | F16L 3/02 248/231.91 |
| 2014/0265095 | A1* | 9/2014 | Gaeta | E04F 21/0069 269/46 |
| 2020/0199865 | A1* | 6/2020 | McEndree | E04F 21/1855 |

FOREIGN PATENT DOCUMENTS

| | | | | |
|---|---|---|---|---|
| GB | 2554152 | A * | 3/2018 | E04F 21/185 |
| WO | WO-2007127125 | A2 * | 11/2007 | E04F 21/185 |

* cited by examiner

CROWN MOLDING SUPPORT HANGER

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention relates to a crown molding support hanger, and more particularly, an adjustable support hanger for installing crown molding quickly and effectively by a single user.

BACKGROUND OF THE INVENTION

Crown molding is a decorative finishing element that is normally used for capping cabinets, columns, and, most often, interior walls at the point where the wall meets the ceiling. It's only used at the top of a room, thus the term "crown" is used to describe the embellishment of a space.

Crown molding serves several important aesthetic and utilitarian functions, including the obscuring of the rough and abrupt intersection of a ceiling and wall, the general enhancement and refinement of the decor and design of a room, and the stabilization of some wall coverings where they intersect with a ceiling. However, because of the inherently elevated, overhead location of crown molding, installation can be cumbersome and difficult, sometimes requiring the cooperation of two or more workers.

Prior art methods of installing crown molding require the location of the molding to be determined by holding a segment of the molding against an intersecting ceiling and wall. This method frequently results in inaccurate molding placement as evidenced by the misalignment of intersecting crown molding segments at the corners of a room.

Ceiling crown molding often requires two or more workers due to measuring the overhead location, positioning and supporting of the crown moldings. One worker would do the fitting and nailing on the left end of the crown molding strip and the second worker supports the opposite end of the crown molding strip. Most ceilings are 8 feet or higher and crown molding is placed against the ceiling and nailed to the wall with the workers using ladders to install the crown molding. One or both of the workers work their way along the length of the crown molding and nail and fit it into its final position.

Often two or more workers aren't available to help with the installation of the crown molding or it becomes too costly, labor wise, for more than one person to install. An independent contractor may also decline taking on the job of installing the crown molding because they work alone and are unable to secure a skilled worker and can't do the installation on their own. Accordingly, the present invention provides a device that enables one person to install a single piece of crown molding, in various dimensions, lengths and configurations, horizontally on a wall and ceiling surface. Crown molding and other decorative trim which are herein incorporated or improved by the present invention.

While there are some products that have been advanced to facilitate the installation of crown molding and other decorative trim which are herein incorporated or improved by the present invention.

BRIEF DESCRIPTION OF THE INVENTION

The primary object of the present invention is to provide a crown molding support hanger for attaching decorative trim molding to walls, at ceiling joint, in a desired location, when you don't have a second set of hands substantially eliminating or reducing disadvantages and problems associated with prior devices.

In order to achieve this aspect, the crown molding support hanger has a support surface that engages and holds a length of crown molding while the mounting member secures the crown molding support hanger to the wall. The present invention is adjustable to the different sizes and shapes of decorative trim molding by simple snapping of the tabs on the support surface that engage the front section of the molding.

When hanging crown molding, simply mark the location of the crown molding by size and then determine the best location for mounting the crown molding support hanger by securing to the wall with your preferred fastener. Once the present invention is mounted to the wall you can run a tape measure along the ceiling or wall, using the present invention to support the tape measure, to get an accurate measurement before installing the molding.

Once you have your crown molding ready to install you only need to place the crown molding in the support member of the crown molding support hanger then attach the molding to the ceiling. Once attached to the ceiling and wall, you can remove the support member by snapping off the end of the mounting member making it easy to remove, as you work your way along the wall. Finish the installation by attaching the crown molding to the wall and ceiling.

Comprised of heavy duty ABS plastic material, it is also the object of the crown molding support hanger that it is safe to use and does not mark or scratch the surfaces of the wall or the molding during the installation.

These and other features and advantages of the invention will be readily apparent from the following detail description of an embodiment thereof and reference to the accompanying drawings.

DESCRIPTION OF CERTAIN EMBODIMENT OF THE PRESENT INVENTION

In the following detailed description of the preferred embodiment, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
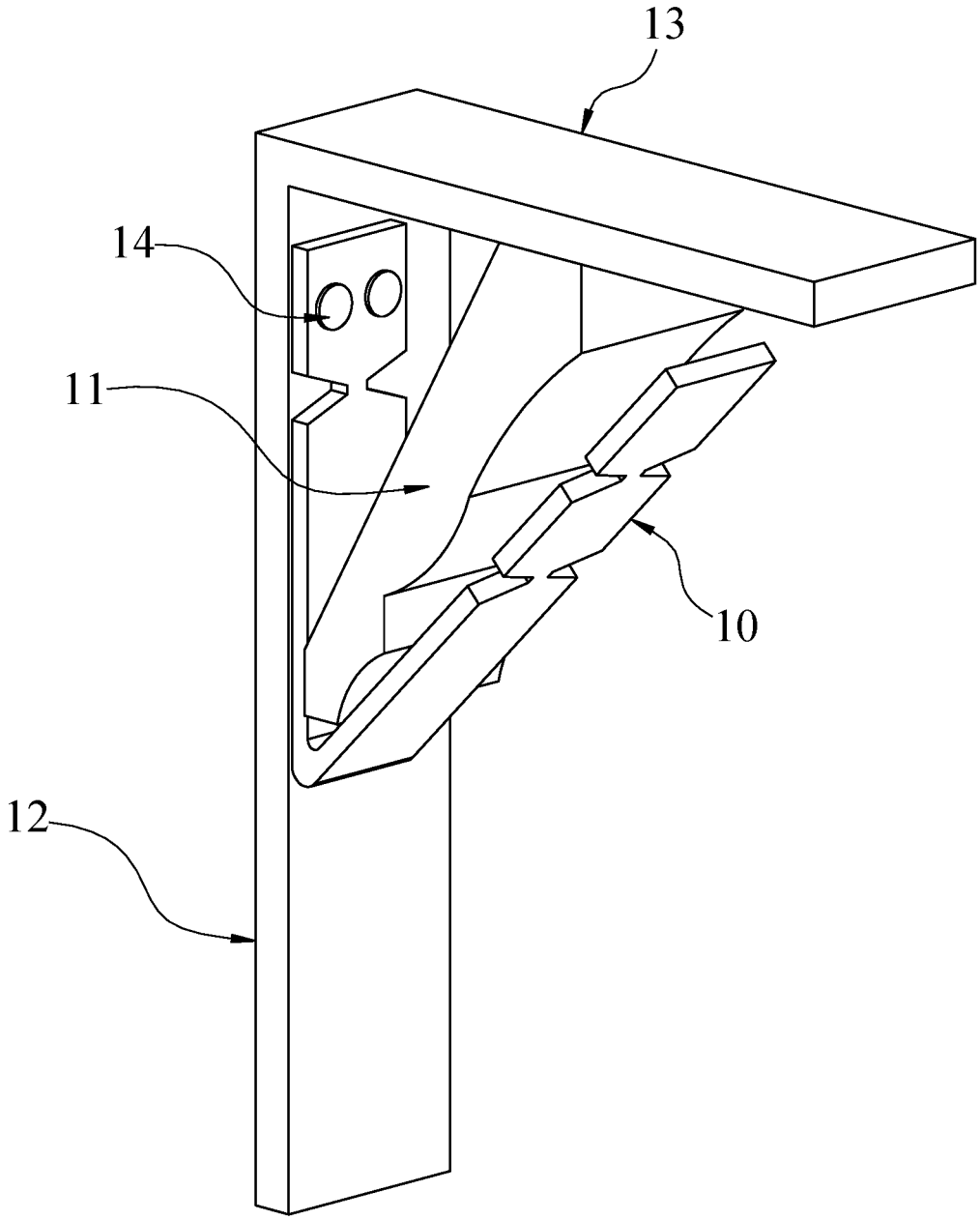
FIG. 1 is a front perspective view of the crown and molding support hanger in the preferred embodiment with the invention supporting a piece of crown molding.

The present invention shown in FIG. 1 illustrates the crown molding support hanger 10 specifically designed to hold crown molding 11 to be installed between the wall 12 and the ceiling 13 by attaching fastener 14 to the wall 12.

Figure 2:
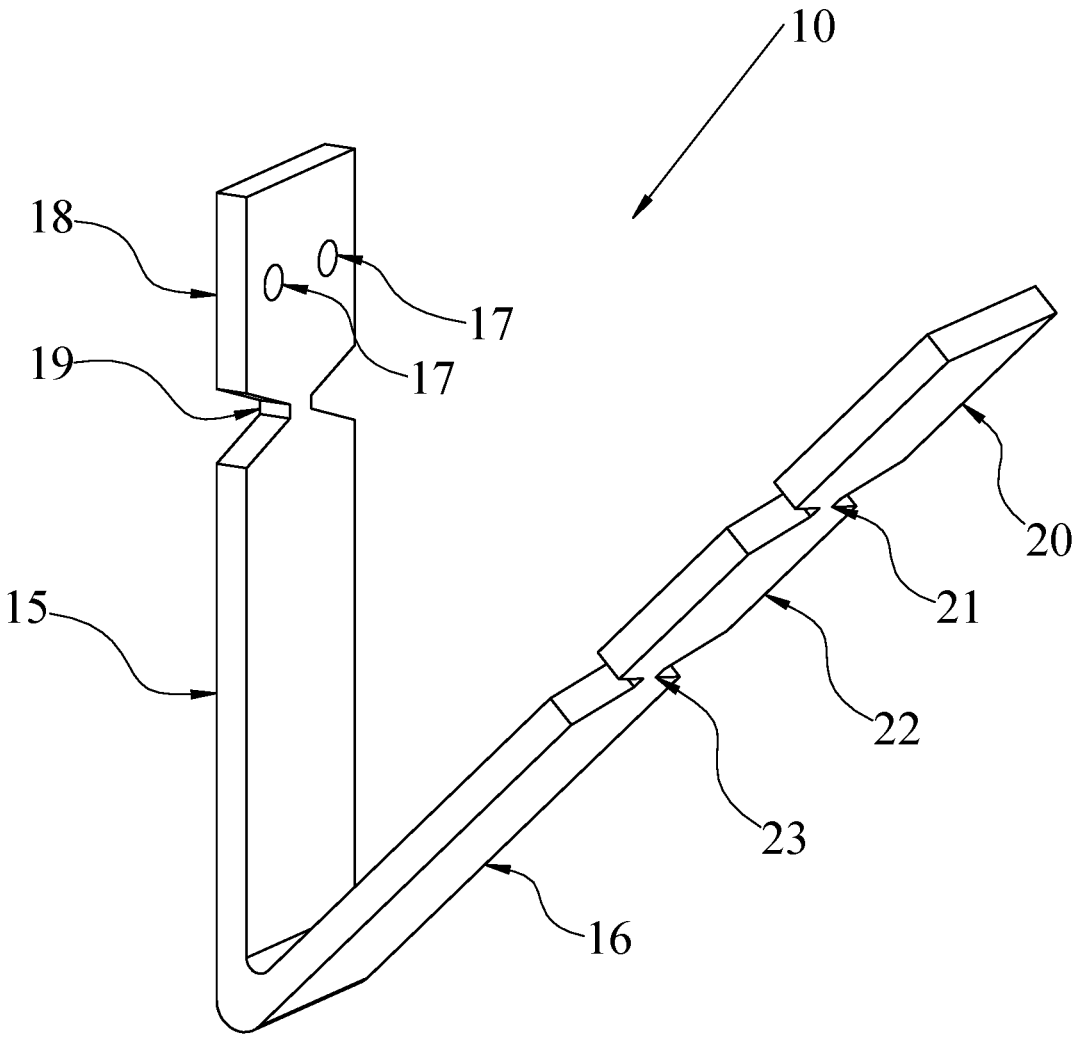
FIG. 2 is a perspective view of the crown molding support hanger provided in accordance with the principle of the present invention.
Figure 3:
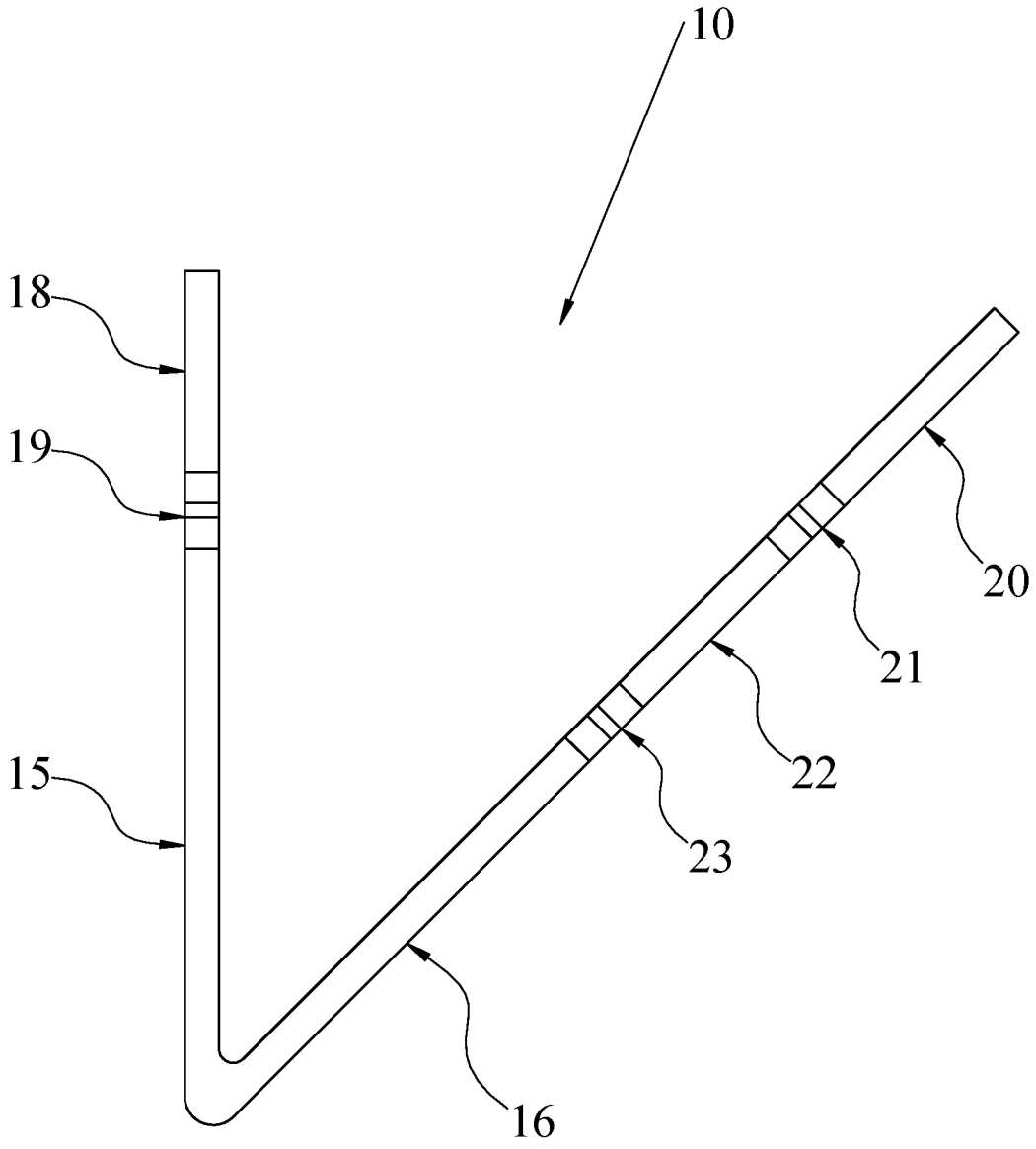
FIG. 3 is a side elevation view of the crown molding support hanger shown in FIG. 2.

Shown in FIGS. 2 and 3 is a perspective view and side view of the crown molding support hanger 10 comprising a mounting member 15 and a removal support member 16 together in pre-installation position according to the present invention. The crown molding support hanger 10 has a mounting member 15 and a support member 16. The mounting member 15 has a breakaway tab 18 with the fastener holes 17 and a breakaway v-groove 19. Further, in the illustrated exemplary embodiment, the support member 16 has a breakaway tab 20 and a breakaway tab 22 that are made for removal by the breakaway v-groove 21 and 23 of the support member 16.

Figure 4:
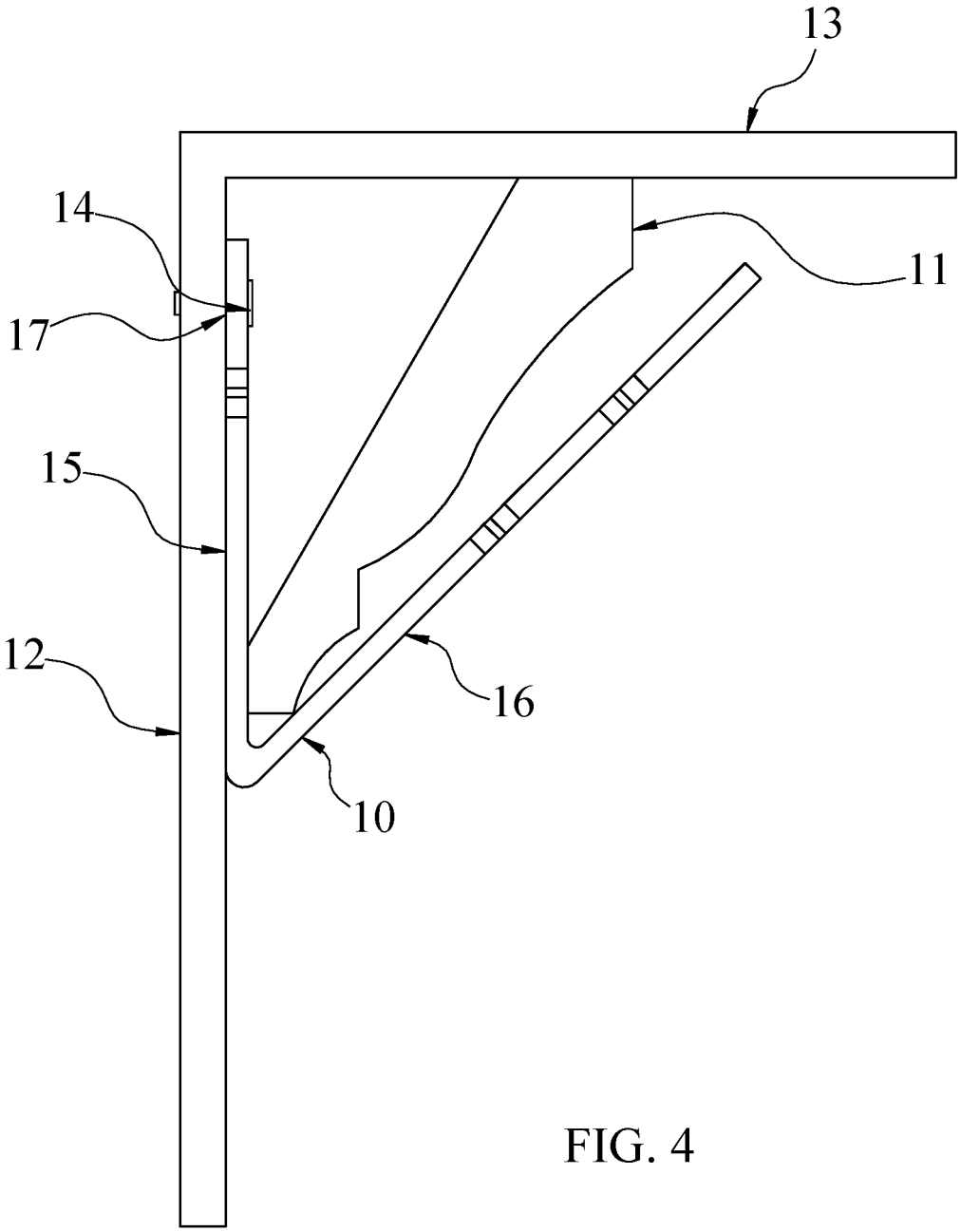
FIG. 4 is a side elevation of the crown molding support hanger shown in FIG. 2 with the crown molding support hanger against the ceiling and an adjoining wall of the room.

More specifically, as shown in FIG. 4, a side elevation of the crown molding support hanger 10 showing wall mounting member and support member 15, 16 respectively, flush with the vertical wall surface 12 and secured by inserting fasteners 14 into the mounting member 15 fastener holes 17. The support member 16 is shown holding the crown molding 11 in the proper installation position between the wall 12 and ceiling 13, which frees the user from having to hold the piece of crown molding 11. Removal of the support member is depicted in FIGS. 5 and 6.

Figure 5:
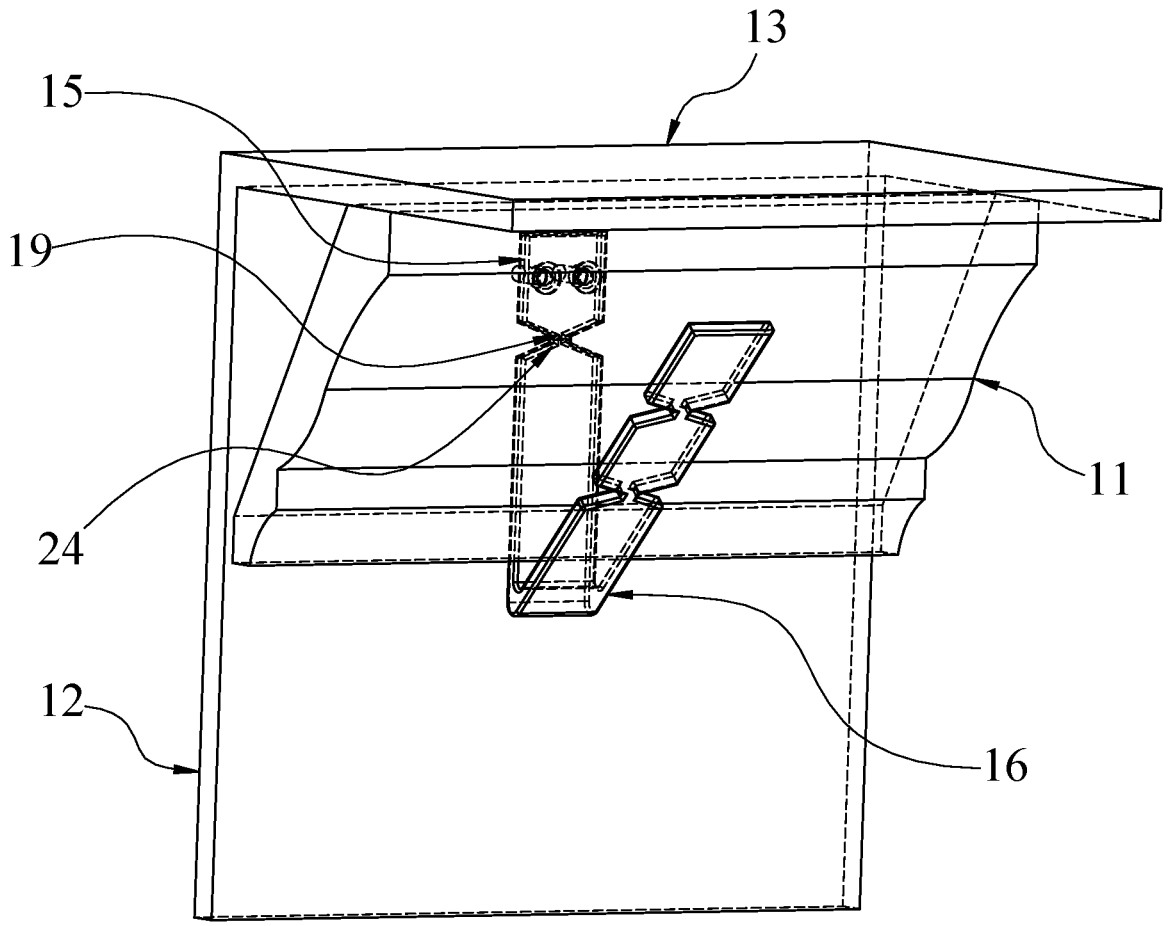
FIG. 5 is a front perspective view showing the manner in which the support member portion of the crown molding support hanger is removed from the sidewall.
Figure 6:
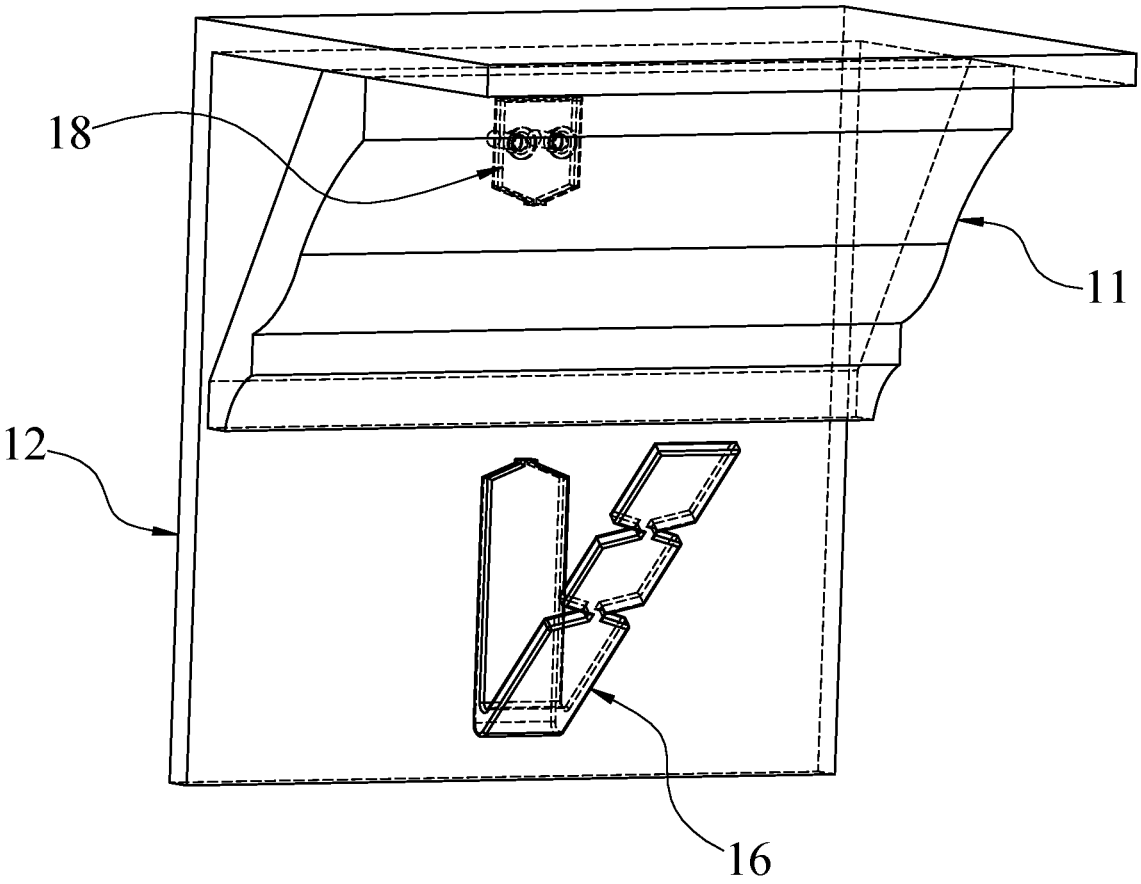
FIG. 6 is a front perspective view after separation of a crown molding support hanger further illustrating the support member embodiment of the present invention.

As depicted in FIGS. 5 and 6, the crown molding 11 is secured in its proper position to the ceiling 13 and the support member 16 is ready to be removed from the wall 12. Substantially, shown in FIG. 5, before separation, the support member 16 can be disengaged from the mounting member 15 by sliding the support member 16 side to side vertically along the wall. The support member 16 will snap off at the v-groove 19 normal breaking point bridge 24. More specifically, as shown in FIG. 6, after separation, the support member 16 can be removed by sliding the support member downward from behind the crown mold 11. The breakaway tab 18 will remain on the wall 12 and will be hidden by the crown mold 11.

Figure 7:
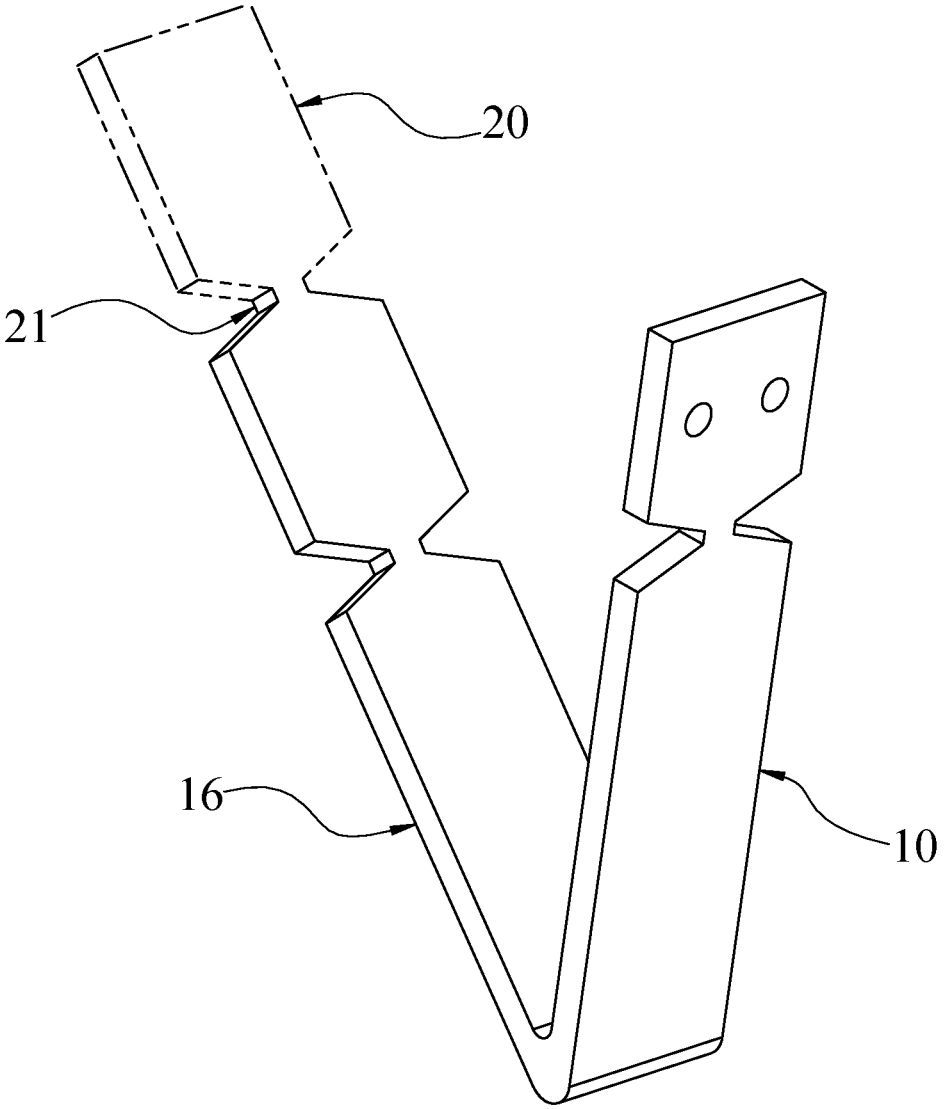
FIG. 7 is a perspective view of one embodiment illustrating the support member removable tab for a slightly smaller molding.

As best seen in FIG. 7, a perspective view of the crown molding support hanger 10 illustrating the support member 16 before snapping off the breakaway tab 20 by the rotation of the breakaway tab 20 at the v-groove 21 location.

Figure 8:
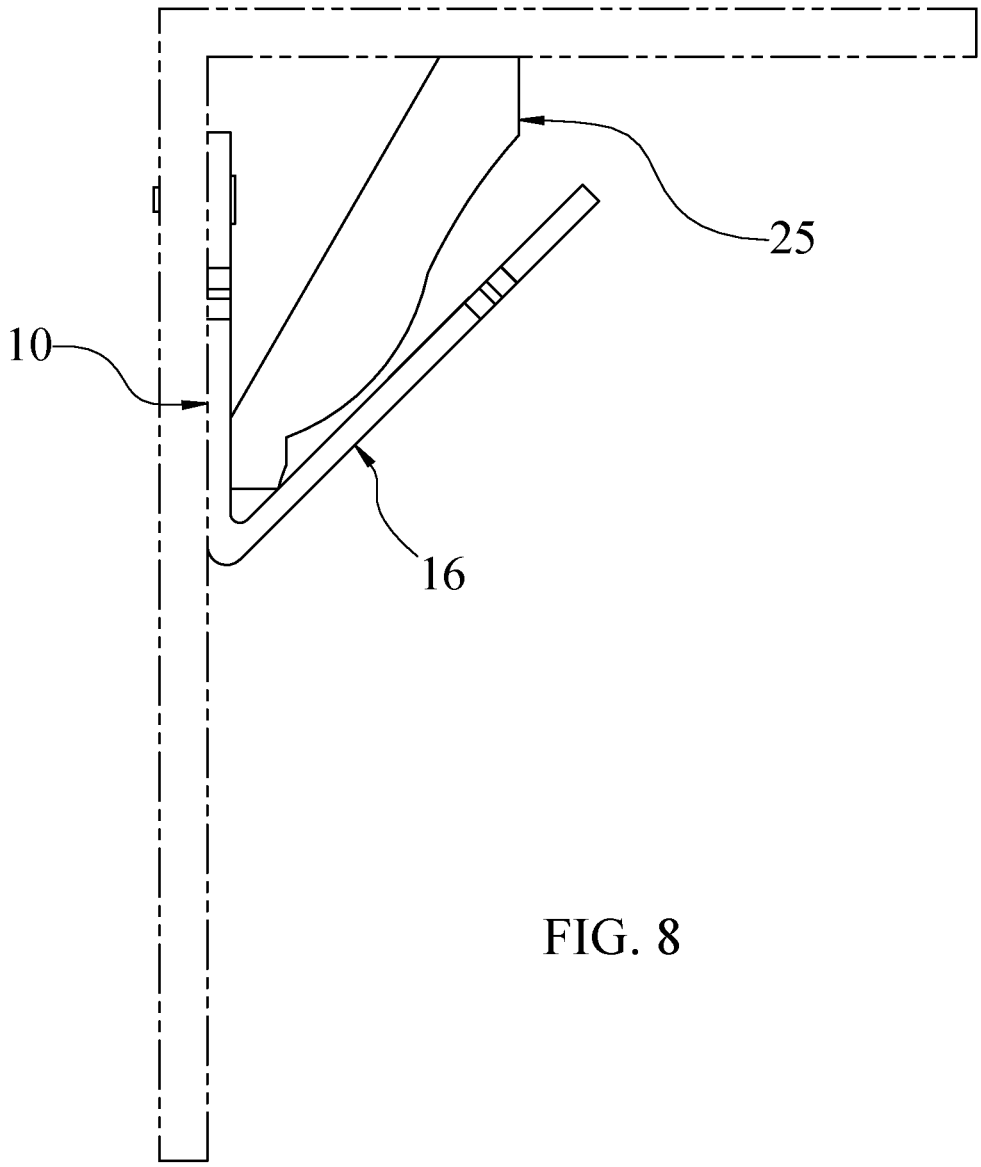
FIG. 8 is a perspective view of one embodiment illustrating the support member removable tab for use with an even smaller crown molding.

As shown in FIG. 8 a perspective view of the crown molding support hanger 10 illustrating the support member 16 after snapping off the breakaway tab 20 (not shown) for the support of a slightly smaller crown molding 25.

Figure 9:
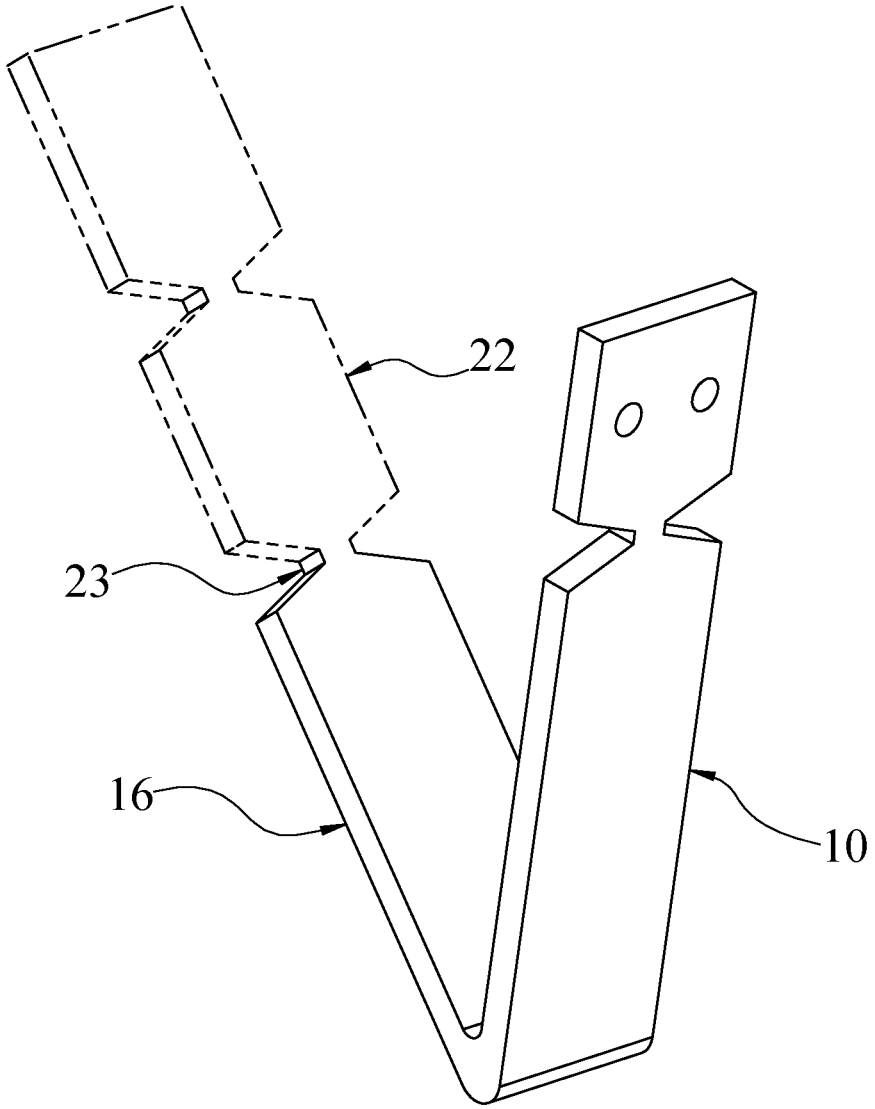
FIG. 9 is a perspective view of the crown molding support hanger before snapping off the breakaway tab for use with an even smaller crown molding.

As shown in FIG. 9 a perspective view of the crown molding support hanger 10 illustrating the support member 16 before snapping off the breakaway tab 22 by the rotation of the breakaway tab 22 at the v-groove 23 location.

Figure 10:
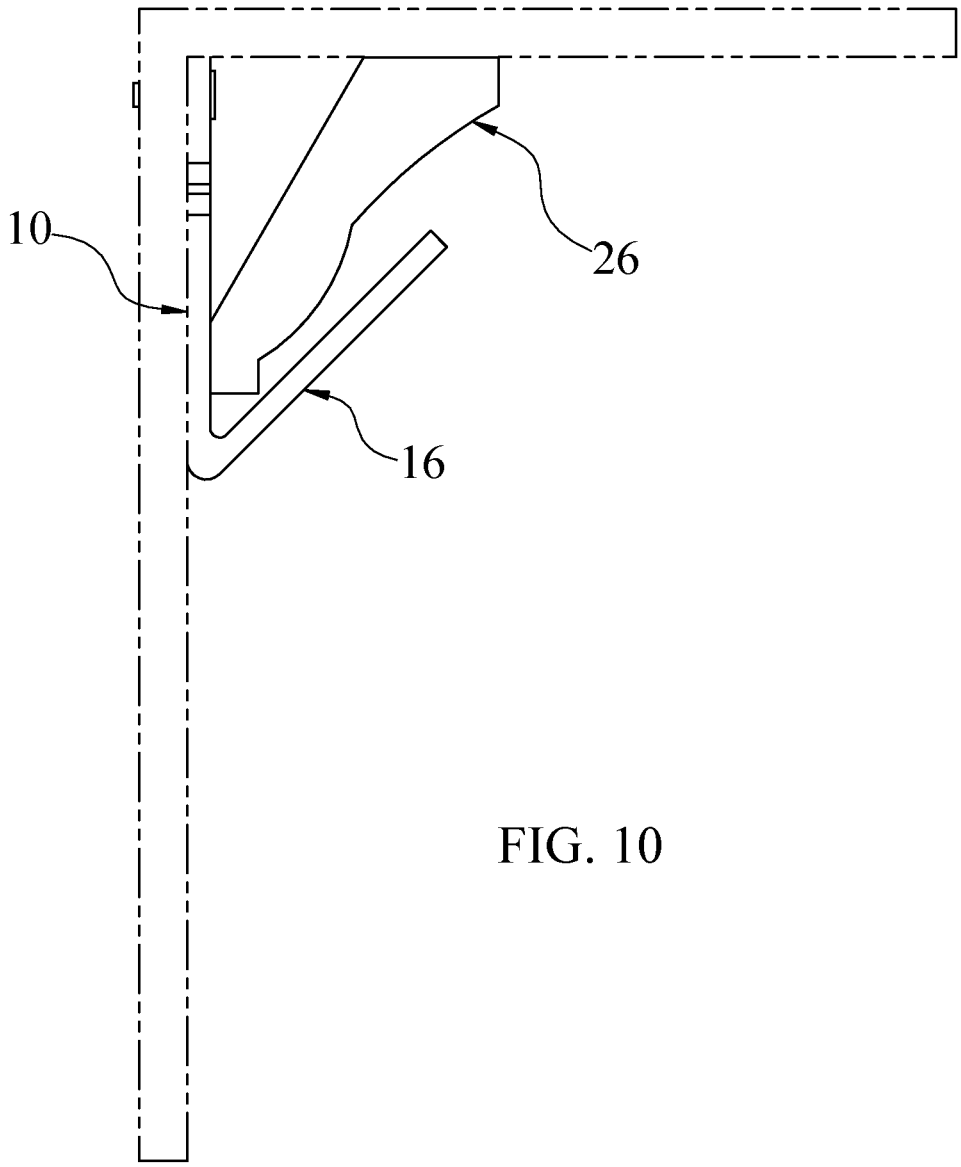
FIG. 10 is a perspective view of the crown molding support hanger after snapping off the breakaway tab for use with an even smaller crown molding.

As shown in FIG. 10 a perspective view of the crown molding support hanger 10 illustrating the support member 16 after snapping off the breakaway tab 20 (not shown) for the support of a slightly smaller crown molding 26.

What is claimed is:

1. A break-away crown molding support hanger for holding decorative trim molding to walls at a ceiling joint in a desired location, comprising:

a break away crown molding support hanger having a support member configured to support a length of decorative trim adjacent the ceiling joint, the support member having a first end, a second end, and lateral sides extending from the first end to the second end, and a mounting member extending at an angle from the second end of the support member, the mounting member having a first end, and second end, and lateral sides extending from the first end to the second end, and configured to secure the crown molding support hanger to the wall;

wherein the mounting member is formed with a pair of V-shaped grooves aligned on each of the lateral sides of the mounting member, the area of the mounting member between the first end of the mounting member and the pair of V-shaped grooves forming a break away tab, the break-away tab configured to remain behind the decorative trim and the remainder of the support hanger below the break-away tab configured to be snapped off by rotating the mounting member laterally back and forth so to remove the support hanger at the V-shaped grooves after the decorative trim has been installed.

2. The break-away crown molding support hanger of claim 1, wherein the support member comprises at least one pair of V-shaped grooves aligned on each of the lateral sides of the support member, the V-shaped grooves are configured to enable the support member to be snapped off to provide the ability to support decorative trim of different sizes and shapes.

3. The break-away crown molding support hanger of claim 1, in which the mounting member is provided with two fastener holes for securing the crown molding support hanger to said wall keeping the crown molding support hanger from moving when rotating the support hanger at the V-shaped grooves.

4. The break-away crown molding support hanger of claim 1, wherein said break-away crown molding support hanger is formed of a rigid plastic material.

* * * * *